US011319141B2

(12) United States Patent
Trani et al.

(10) Patent No.: US 11,319,141 B2
(45) Date of Patent: May 3, 2022

(54) EDIBLE OR COMESTIBLE PRODUCT DISPENSER

(71) Applicant: The Topps Company, Inc., New York, NY (US)

(72) Inventors: Anthony Trani, Brooklyn, NY (US); Cynthia Mangold, Santa Monica, CA (US); Emma Bacon, Jersey City, NJ (US); Jason Reinbold, Jersey City, NJ (US); James E. McCay, Fairfield, CT (US); John Kevin Clay, Milford, CT (US); John T. Nelson, Dunwoody, GA (US); Cara Lustik, New York, NY (US); Edward R. Curtin, Wayne, NJ (US); Jennifer Whetzel, Portland, ME (US); Joan Llabaria Lage, Madrid (ES); Ignacio Cugat Fiter, Madrid (ES); Wang Haibin, Fujian (CN)

(73) Assignee: THE BAZOOKA COMPANIES, INC., New York, NY (US)

( * ) Notice: Subject to any disclaimer, the term of this patent is extended or adjusted under 35 U.S.C. 154(b) by 42 days.

(21) Appl. No.: 16/586,141

(22) Filed: Sep. 27, 2019

(65) Prior Publication Data

US 2020/0255210 A1 Aug. 13, 2020

Related U.S. Application Data

(60) Provisional application No. 62/804,571, filed on Feb. 12, 2019.

(51) Int. Cl.
*B65D 83/08* (2006.01)
*B65D 85/60* (2006.01)
(Continued)

(52) U.S. Cl.
CPC ..... *B65D 83/0882* (2013.01); *B65D 83/0876* (2013.01); *B65D 85/60* (2013.01);
(Continued)

(58) Field of Classification Search
CPC ..... B65D 83/0829; B65D 83/0841; B65D 83/0876; B65D 83/0882; B65D 85/60;
(Continued)

(56) References Cited

U.S. PATENT DOCUMENTS 2,750,029 A * 6/1956 Morgan ..... B65H 35/0026 225/7
5,133,980 A * 7/1992 Ream et al. ..... B65H 35/002 426/115

(Continued)

FOREIGN PATENT DOCUMENTS

DE 2 307 107 * 8/1974 ..... B65H 37/005
FR 1.336.770 * 7/1963 ..... B65H 35/0086
FR 1.349.490 * 12/1963 ..... B65H 37/005

*Primary Examiner* — Clark F Dexter
(74) *Attorney, Agent, or Firm* — Dentons US LLP

(57) ABSTRACT

A dispenser for dispensing an edible product, preferably in the form of a tape, and more preferably a roll of tape. The dispenser includes a dispenser body in which the product is contained, and a pusher which engages a surface of the product to push the product out of an opening in the dispenser body.

33 Claims, 8 Drawing Sheets

(51) Int. Cl.
*B65D 85/672* (2006.01)
*B65H 35/00* (2006.01)
*B65H 37/00* (2006.01)

(52) U.S. Cl.
CPC ..... *B65D 85/672* (2013.01); *B65H 35/002* (2013.01); *B65H 35/0086* (2013.01); *B65H 37/005* (2013.01); *Y10T 225/21* (2015.04); *Y10T 225/297* (2015.04)

(58) Field of Classification Search
CPC B65D 85/672; B65H 35/002; B65H 35/0026; B65H 35/005; B65H 35/0086; B65H 35/04; B65H 35/06; B65H 35/07; Y10T 225/209; Y10T 225/21; Y10T 225/297
USPC ..... 225/14, 15, 90
See application file for complete search history.

(56) References Cited

U.S. PATENT DOCUMENTS

| | | | |
|---|---|---|---|
| 6,575,345 | B2 | 6/2003 | Pitzen et al. |
| 6,786,447 | B2 | 9/2004 | Geib et al. |
| D541,347 | S | 4/2007 | Porcini et al. |
| D541,864 | S | 5/2007 | Porcini et al. |
| D543,241 | S | 5/2007 | Herrmannsen et al. |
| D546,670 | S | 7/2007 | Sainz |
| D568,692 | S | 5/2008 | Lam |
| D590,444 | S | 4/2009 | Farnworth et al. |
| D592,249 | S | 5/2009 | Chang |
| 7,563,468 | B2 | 7/2009 | Bougoulas et al. |
| D609,274 | S | 2/2010 | Hsu et al. |
| D612,429 | S | 3/2010 | Hochmuth |
| D615,592 | S | 5/2010 | Shaha et al. |
| D640,325 | S | 6/2011 | Broen et al. |
| D640,742 | S | 6/2011 | Booty, Jr. |
| 8,002,113 | B1 | 8/2011 | Cummings |
| D656,548 | S | 3/2012 | Packard et al. |
| D656,549 | S | 3/2012 | Packard et al. |
| D663,775 | S | 7/2012 | Hsu |
| 8,230,996 | B1 | 7/2012 | Cummings |
| D666,243 | S | 8/2012 | Hagglund et al. |
| D671,596 | S | 11/2012 | Ruthe-Steinsiek |
| D671,991 | S | 12/2012 | Hagglund et al. |
| 8,322,262 | B2 | 12/2012 | Ryu |
| 8,499,965 | B2 | 8/2013 | Sheffield |
| D708,065 | S | 7/2014 | Pourian |
| D709,947 | S | 7/2014 | Broen et al. |
| 9,630,797 | B2 | 4/2017 | Ferracane et al. |
| 9,902,551 | B2 * | 2/2018 | Krook et al. ..... A61F 13/64 |
| 10,005,633 | B2 | 6/2018 | Foreman |
| 10,118,789 | B2 | 11/2018 | Calman et al. |
| 2016/0221788 | A1 * | 8/2016 | Foreman ..... B65D 85/672 |
| 2017/0096286 | A1 | 4/2017 | Pourian et al. |
| 2017/0253420 | A1 * | 9/2017 | Smith ..... G01N 33/48757 |
| 2018/0290854 | A1 | 10/2018 | Foreman |

* cited by examiner

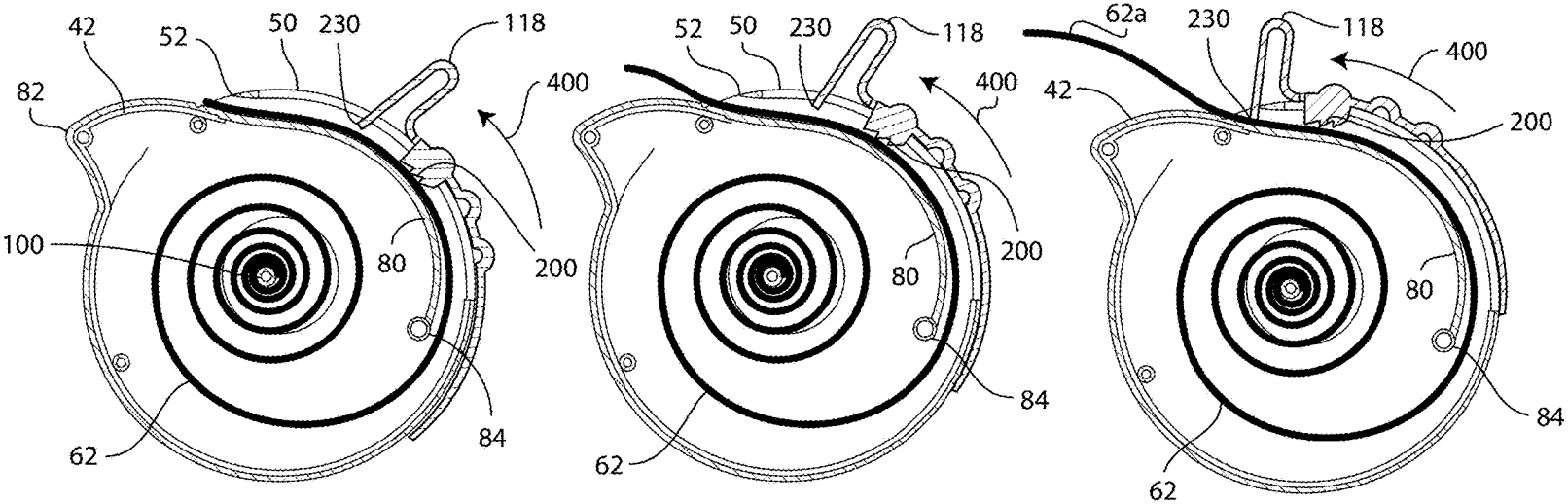
FIG. 14
FIG. 15
FIG. 16
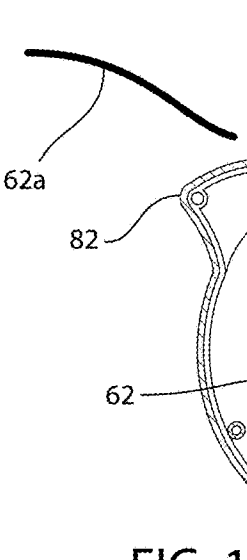
FIG. 17
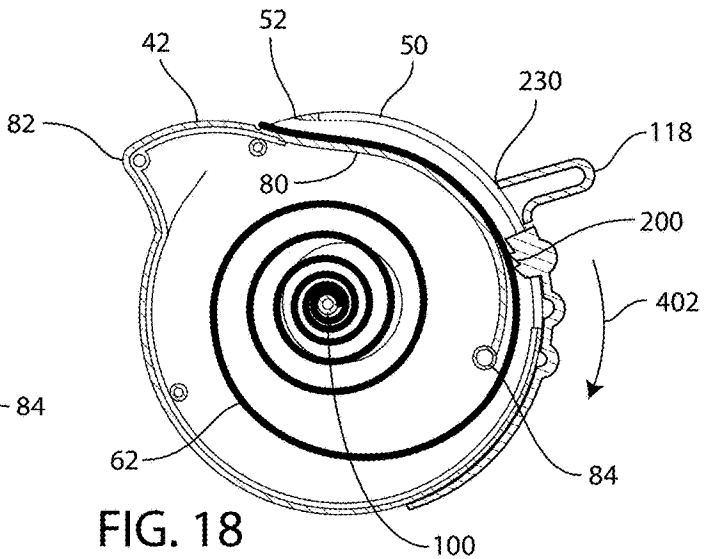
FIG. 18

EDIBLE OR COMESTIBLE PRODUCT DISPENSER

BACKGROUND

The present disclosure generally relates to packaging for edible or comestible products. More particularly, in an embodiment, the disclosure relates to packaging for confectionary or fruit products. Yet more particularly, in an embodiment, the disclosure relates to edible products provided in the form of a tape or belt.

Several food or edible products are provided in the form of a roll of tape. One example is the Wm. Wrigley Jr. Company's Hubba Bubba brand chewing gum. This product is sold in a clam shell style container that is split into two halves. The halves are hingedly connected. The consumer opens and closes the container to access the chewing gum.

Another product is General Mills, Inc.'s Fruit by the Foot brand of fruit snack. A spirally-wound tape or belt of the fruit snack is sold in a pouch. The fruit snack belt is rolled-up within itself together with release paper which serves to separate the layers of the roll and thus the product from devolving into a single sticky clump.

SUMMARY OF THE DISCLOSURE

Disclosed herein are one or more inventions for a dispenser for edible or comestible products. The products preferably are in tape or belt-shaped form. The tapes preferably are in the form of spirally wound rolls.

The terms edible and comestible are used interchangeably herein.

The terms tape, belt, and strip are used interchangeably herein when referring to an edible product.

The terms nibs and prong are used interchangeably herein to refer to a protrusion or member used to engage a surface of an item so that the item can be caused to move upon urging or moment of the nibs or prong.

The terms user and consumer are used interchangeably herein to refer to a person who manipulates the dispenser.

The terms rod, spindle and axle are used interchangeably to refer to a post member about which another item can rotate.

In an embodiment, there is disclosed a dispenser comprising: (a) a dispenser body with an axis, the dispenser body have a first wall and a second wall that are spaced apart along the axis and a third wall connecting the first and second walls and extending around the axis; and (b) a pusher secured for movement relative to the dispenser body, wherein, the dispenser body includes a cavity within which can be held an edible product, the dispenser body includes an opening in the third wall via which the product can be extracted, the dispenser body includes a dispensing surface upon which the product can travel and which extends at least from inside the cavity to the opening, the dispenser body includes a slot in the third wall of the dispenser body over the dispensing surface, and the pusher includes a prong that fits within the slot.

In an embodiment, the dispensing surface extends outside of the opening as a lip.

In an embodiment, each of the first wall and the second wall includes a boss centered on the axis, and the pusher includes two spaced apart panels, each with an opening into which a respective boss is received, the pusher being secured for pivotal movement about the bosses.

In an embodiment, each of the openings is sized larger than the boss engaged therein such that the pusher can be moved perpendicular to the axis thereby to permit the prong to engage and be disengaged from the surface of the edible tape.

In an embodiment, the pusher further comprises a partially separated tongue from which the prong extends, the tongue being depressible relative to a remainder of the pusher.

In an embodiment, the dispenser body further comprises a protrusion extending from the third wall, an upper surface of which is comprised of the dispensing surface as a lip and a lower surface of which is spaced from the upper surface and provides a finger-rest.

In an embodiment, the first wall, the second wall, or each of the first wall and the second wall includes depressions in the outer surface thereof.

In the embodiment the depressions are effective to provide enhanced gripping of the dispenser relative to a smooth surface.

In an embodiment, the first wall or the second wall includes a spindle extending into the cavity and which can receive the roll of the edible tape.

In an embodiment, the dispensing surface is continuous with the third wall.

In an embodiment the dispensing surface has a first section extending from an inner surface of the first wall and a second section that extends from an inner surface of the second wall.

In an embodiment, the first section has first and second sub-sections relative to a circumferential direction around the axis, a width of the first sub-section along the axis being relatively smaller than a width of the second sub-section along the axis; the second section has third and fourth sub-sections relative to the circumferential direction around the axis, a width of the thirds sub-section along the axis being relatively smaller than a width of the fourth sub-section along the axis, and the first sub-section faces the fourth sub-section and the second sub-section faces the third sub-section.

In an embodiment, a roll of an edible tape is contained within the dispenser.

In an embodiment, the edible tape is a confectionary product.

In an embodiment, the confectionary product is a candy.

These and other features and aspects of the invention(s) are discussed in greater detail below in the detailed description of the exemplary embodiments with reference to the accompany drawings.

BRIEF DESCRIPTION OF THE DRAWINGS

FIG. 14 illustrates in cross section the right-side half of the dispenser of FIG. 1 and the roll of tape of edible product with the pusher in a first position during a push action.

FIG. 15 illustrates in cross section the right-side half of the dispenser of FIG. 1 and the roll of tape of edible product with the pusher in a second position during the push action.

FIG. 16 illustrates in cross section the right-side half of the dispenser of FIG. 1 and the roll of tape of edible product with the pusher in a third position at the end of the push action.

FIG. 17 illustrates in cross section the light-side half of the dispenser of FIG. 1 and the roll of tape of edible product in the third position with the pusher in the third position, and a portion of the edible product separated from the roll.

FIG. 18. Illustrates in cross section the right-side half of the dispenser of FIG. 1 and the roll of tape of edible product with the pusher in in a fourth position at the end of a retraction action and poised for a push action.

DETAILED DESCRIPTION

Figure 1:
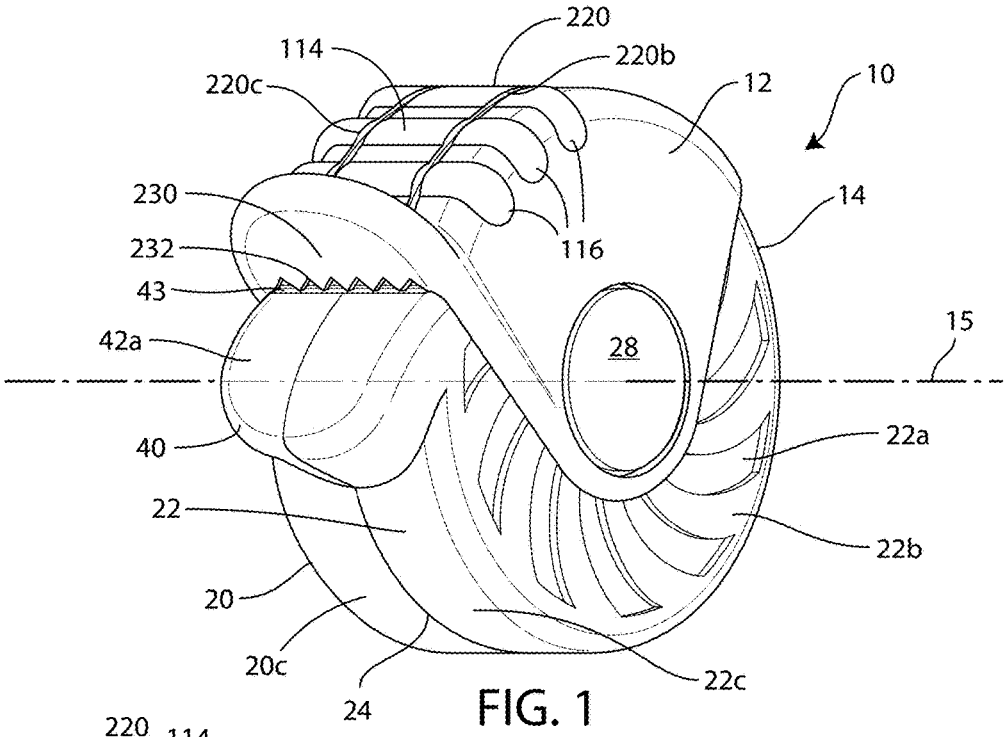
FIG. 1 illustrates in a first perspective view a dispenser embodying principles of the invention(s).

In FIGS. 1, 2, 6, and 7, there is illustrated a dispenser 10 embodying principles of the invention(s). The dispenser 10 is used to dispense a product in the form of tape, preferably a roll of a spirally wound tape. The roll of tape preferably is relatively loosely spirally wound or has sufficient layer separating powder or other means to prevent the layers of the product from sticking together and to enable easier unrolling of the product.

Although the principles of the inventions(s) have applicability in a variety of areas and to a variety of edible or comestible products, the product preferably is a confectionary product, and most preferably is a candy product. Sometimes the tape is referred herein as an edible tape or even a candy tape.

To reduce clutter, and for ease of understanding, reference numerals are not repeated in all the Figures. Rather, reference numerals are included in those Figures that should provide the best understanding of a feature or items in connection with the description herein.

Figure 2:
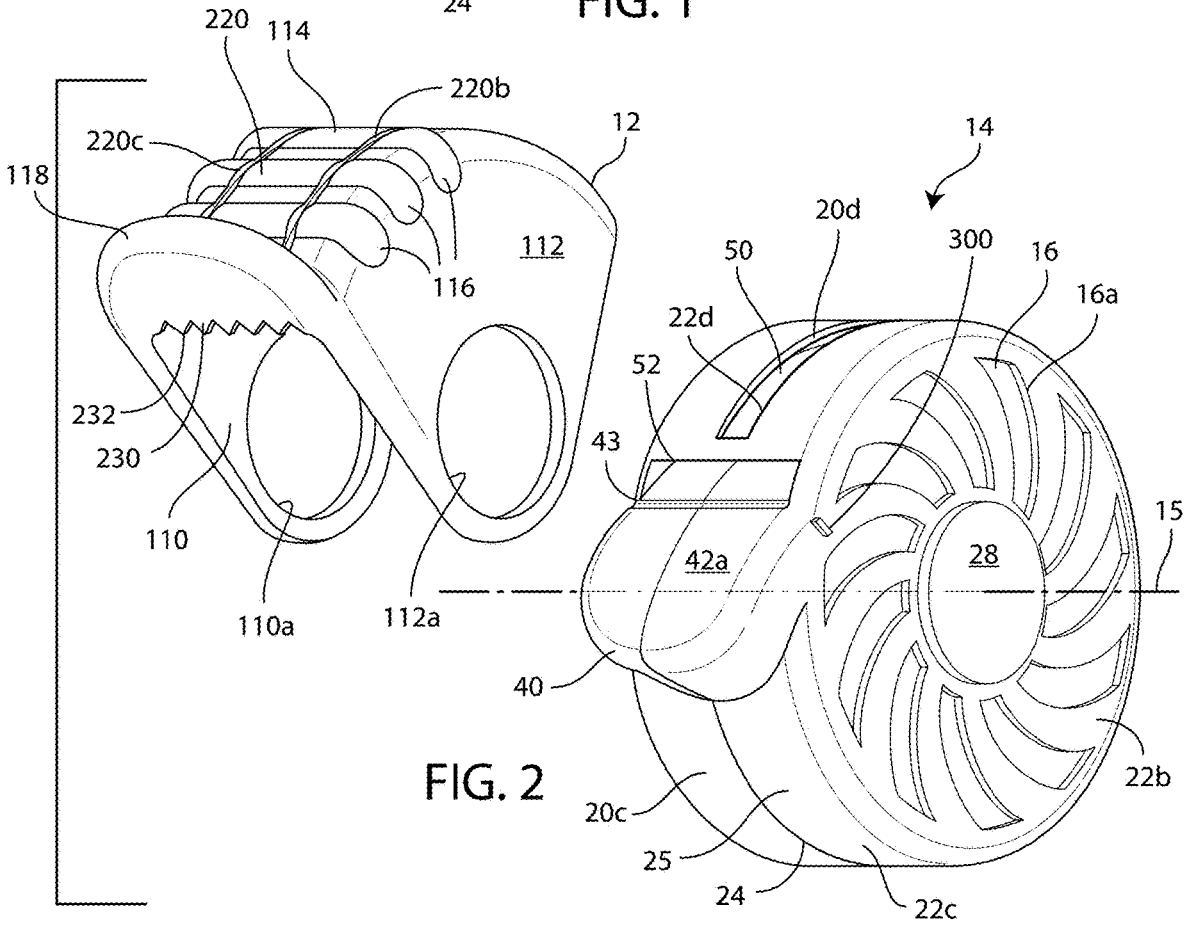
FIG. 2 illustrates in the first perspective view a pusher of the dispenser of FIG. 1 and a dispenser body of the dispenser of FIG. 1 in separation.

In FIG. 1, the dispenser 10 is illustrated assembled and in a first perspective view. In FIG. 2, the pusher 12 and dispenser body 14 are shown separated for ease of understanding but in the same perspective view as in FIG. 1.

Figure 6:
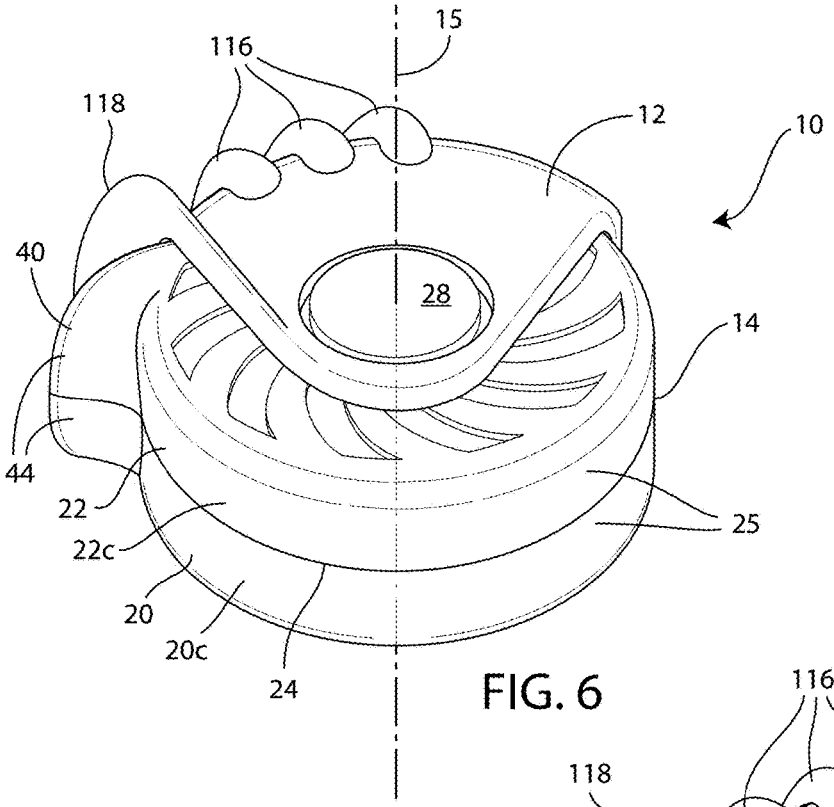
FIG. 6 illustrates in a second perspective view the dispenser of FIG. 1.
Figure 7:
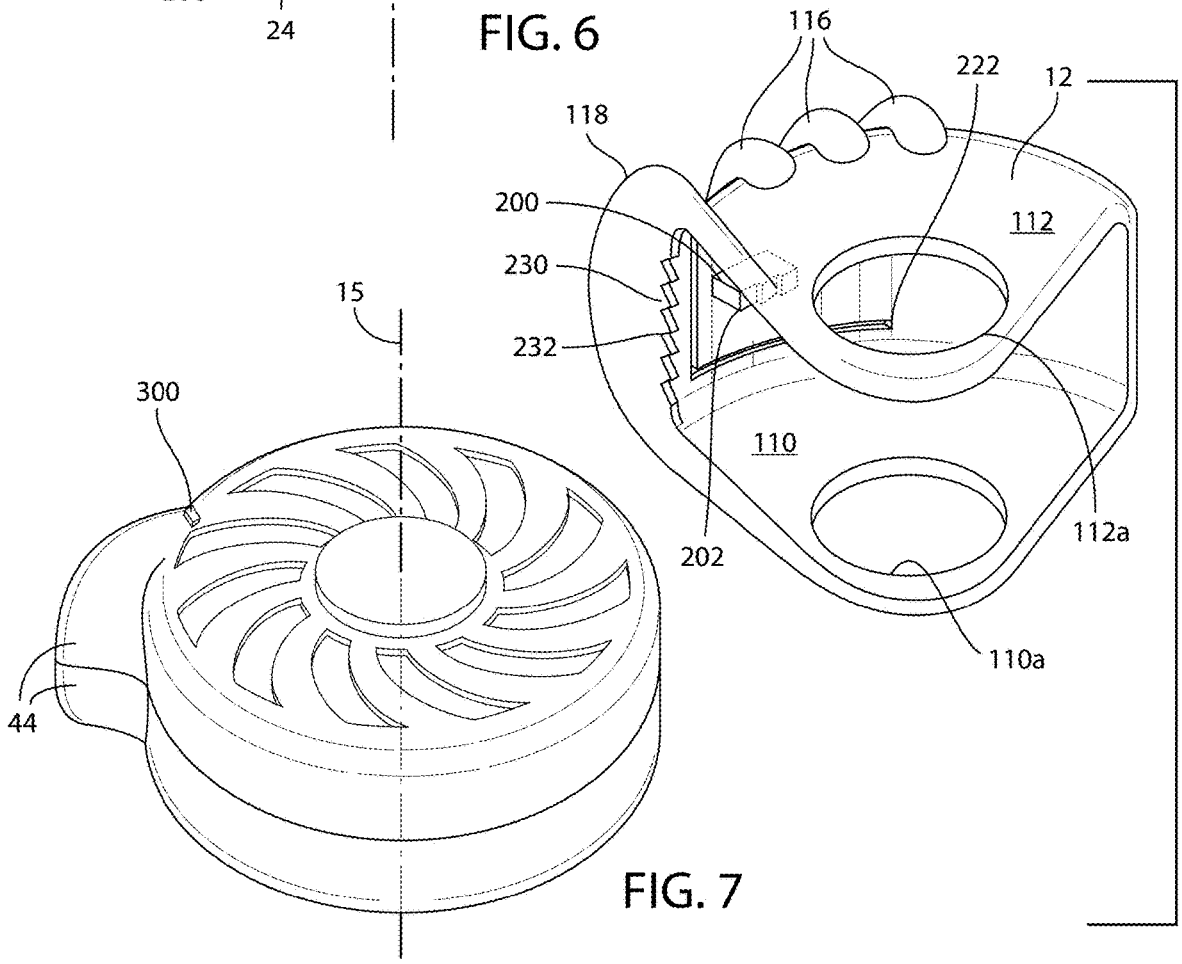
FIG. 7 illustrates in the second perspective view the pusher of the dispenser of FIG. 1 and the dispenser body of the dispenser of FIG. 1 in separation.

In FIG. 6 the dispenser 10 is illustrated assembled and in a second perspective view. In FIG. 7, the pusher 12 and dispenser body 14 are shown separated for ease of understanding but in the same perspective view as in FIG. 6.

The dispenser 10 has two main components, the pusher 12 and the dispenser body 14. The pusher 12 is secured for movement relative to the dispenser body, preferably, pivotal movement around an axis 15 of the dispenser body. In FIGS. 1 and 6, the pusher 12 is shown in a closed position.

As an alternative, not illustrated, but easily understood, the dispenser body can be any suitable shape, including with substantially square sides with a pusher configured to slide along and relative to one of the sides.

Dispenser Body

As shown in FIGS. 1, 2, 6, and 7, the dispenser body 14 is generally shaped like a short squat cylinder or can with a cylindrical diameter perpendicular to the axis 15 of the dispenser body 14. The cylindrical diameter is much greater than a height of the cylinder along the axis 15 of the dispenser body 14. The height of the cylinder can also be considered the width or thickness of the dispenser body 14. For example, the width is about 2.6 cm or 1 1/16 in.

In one embodiment, the diameter of the dispenser body 14 is about 6 cm or 2 3/8 in.

The dispenser body has two halves 20 and 22, which for ease of understanding are referred to herein as a right-side half or first half 20 and a left-side half or second half 22. The halves 20 and 22 are shown separated in FIGS. 8-10. Each of the right-side half 20 and the left-side half 22 includes an end wall with an outer surface that faces away from. the outer surface of the other end wall. The right-side half 20 has end wall 20*a* with outer surface 20*b* and the left-side half 22 has end wall 22*a* with outer surface 22*b*. The end wall 20*a* can be considered a first wall of the dispenser body 14 and the end wall 22*a* can be considered a second wall of the dispenser body 14.

The halves 20 and 22 also have circumferential partial wall portions or skirts 20*c* and 22*c*, respectively, that join together and edges of which abut against each other, to form a third wall 25 of the dispenser body 14. This third wall 25 connects the first and second walls 20*a* and 22*a* and extends around the axis 15. In FIGS. 1, 2, 6, and 7, a seam 24 where the two halves 20 and 22 abut can be seen.

When the first and second dispenser halves 20 and 22 are joined together, the first and second end walls are spaced from each other, and the third wall spans between the first and second end walls at perimeters thereof, thereby forming an enclosed space. As noted above, the first and second end walls can be any suitable shape, but preferably have circular perimeters because the resulting shape conforms more closely about a spirally wound tape, and can be held very comfortably in the hand of a consumer.

The dispenser body 14 includes two bosses 26 and 28. The boss 28 is at the outer surface 22*b* of the left-side half 22 is shown in FIGS. 1, 2, 6-9, and 13. The boss 26 is provided on the outer surface 20*a* of the right-side half 20 is shown if FIGS. 10 and 13. The axis 15 passes through centers of the bosses 26 and 28. The boss 26 and the boss 28, preferably, but not necessarily, are mirror images of each other, at least when considered from the exterior of the dispenser body 14.

As viewed from the exterior of the dispenser body 14, the bosses preferably are formed as solid stubby cylinders. Preferably with respect only to one of the bosses, which in the illustrated embodiment is the boss 26, the boss supports an interior rod, spindle, or axle 100 (shown in FIGS. 8, 9, and 14-18).

Figure 3:
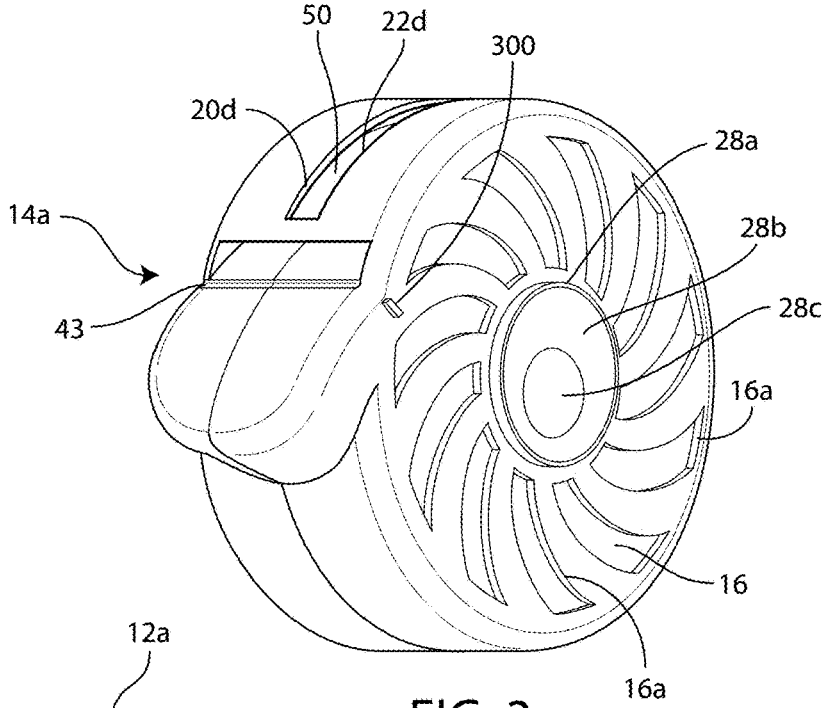
FIG. 3 illustrates in the first perspective view another dispenser body embodying other principles of the invention (s).

In FIG. 3 there is shown an alternative dispenser body 14*a* which is provided with a boss 28*a* with a concavity 28*b* relative to outer perimeter of the boss. The boss also includes a slight semispherical bump or convexity 28*c*. The boss on the oppositely facing wall of the dispenser 14*a* would be the same. This bump 28*c* provides a thickening of the wall sufficient to support the rod, axle, or spindle 100.

As can be appreciated, this bump 28*c* is not concentrically located within the boss because the interior rod, spindle, or axle 100 preferably is located parallel to, but not coincident with, the axis 15. Instead, the rod, spindle, or axle 100 is locate along a second axis that is more centrally located relative to an interior cylindrical space defined by interior members within the enclosed space, as described below.

A design in the form of concavities or depressions 16 is provided on the outer walls or surfaces of each of the left-side half 20 and the right-side half 22. Each concavity 16 preferably, but not necessarily, is in the form of a blade, such as a turbine or fan blade. To an extent, the design also enhances gripping of the dispenser 10 because walls 16*a* of the concavities provide multiple surfaces which are perpendicular to the outer surface of the dispenser half and that can counteract slippage of the dispenser 10 within the fingers of a person's hand.

The presently preferred design is a whirlygig or turbine blade design. However, other designs can be present.

The dispenser body 14 also preferably includes an optional protrusion 40 located distally with respect to a path of travel of the pusher 12. In an embodiment, such a protrusion extends about 1.3 cm or ½ in from the outer perimeter of the dispenser body.

The protrusion 40 preferably includes an outer end 42*a* of a curved or curvilinear dispensing surface 42 in the form of a lip upon which the confectionary tape is supported at least while exiting the dispenser body. Also preferably, as described below, the surface 42 is curved and extends from within the interior of the dispenser body 14 to provide a layer separation function in addition to a tape support function. Only that portion 42*a* of the curved surface 42 that extends outside of the dispenser body cavity can be seen in FIGS. 1, 2, 6, and 7. It is more completely visible and understandable with reference to FIGS. 8-10.

The protrusion 40 also is shaped to provide a finger-rest to accommodate abutting of a finger, usually an index or middle finger of a consumer, much like the finger-rest of a casting rod. Thus, an undersurface 44, is formed with smooth and rounded edges to feel comfortable against the finger of a consumer when the consumer holds the dispenser 10 in their hand.

For reasons explained in greater detail below, the dispensing surface preferably includes an axially extending groove 43. This groove 43 enhances a cutting or segmenting action performed with the pusher 12.

As can be seen best in FIGS. 2, 3, 8-10, and 13, when joined, the two dispenser body halves 20 and 22 form a circumferential slot 50 over the dispensing surface 42. This slot results because of opposed matching cutouts 20*d* and 22*d* in the edges the circumferential partial wall portions 20*c* and 22*c*. The purpose of this slot 50 is to receive a prong or nib of the pusher 12, as described in more detail below. The slot 50 has a distal end near the protrusion 40 and a proximal end in the opposite direction.

In an embodiment, the slot 50 is about 2 mm or 1/16 in. wide in the axial direction and is about 4.7 cm or 2 1/14 in. long.

Also, as described below, the third wall 25 stops short of the dispensing surface 42 such that a slot or opening 52 that axially spans, or nearly fully axially spans the width of the surface 42 is provided above the surface 42. As can be appreciated, the slot 52 allows product to be dispensed or extracted from the interior of the dispenser body 14, through the slot 52, while being supported on the dispensing surface 42.

In an embodiment, the slot 52 is about 3 mm or ⅛ in. wide in the radial direction. Further, it is located about 5 mm or ¼ in from the distal end of the slot 50.

Figure 8:
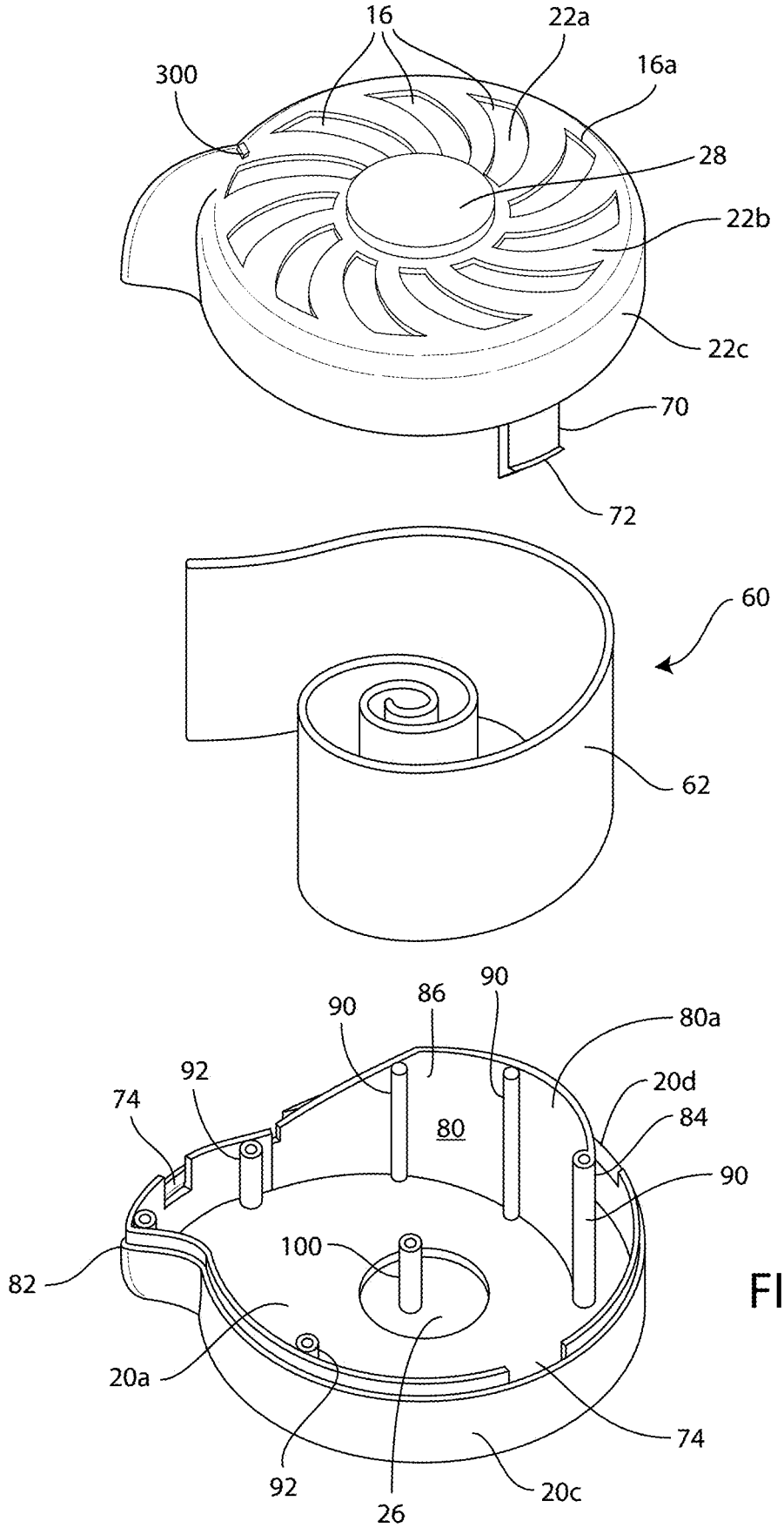
FIG. 8 illustrates in a first exploded view of two halves of the dispenser of FIG. 1 and a roll of tape of an edible product contained in the dispenser.
Figure 9:
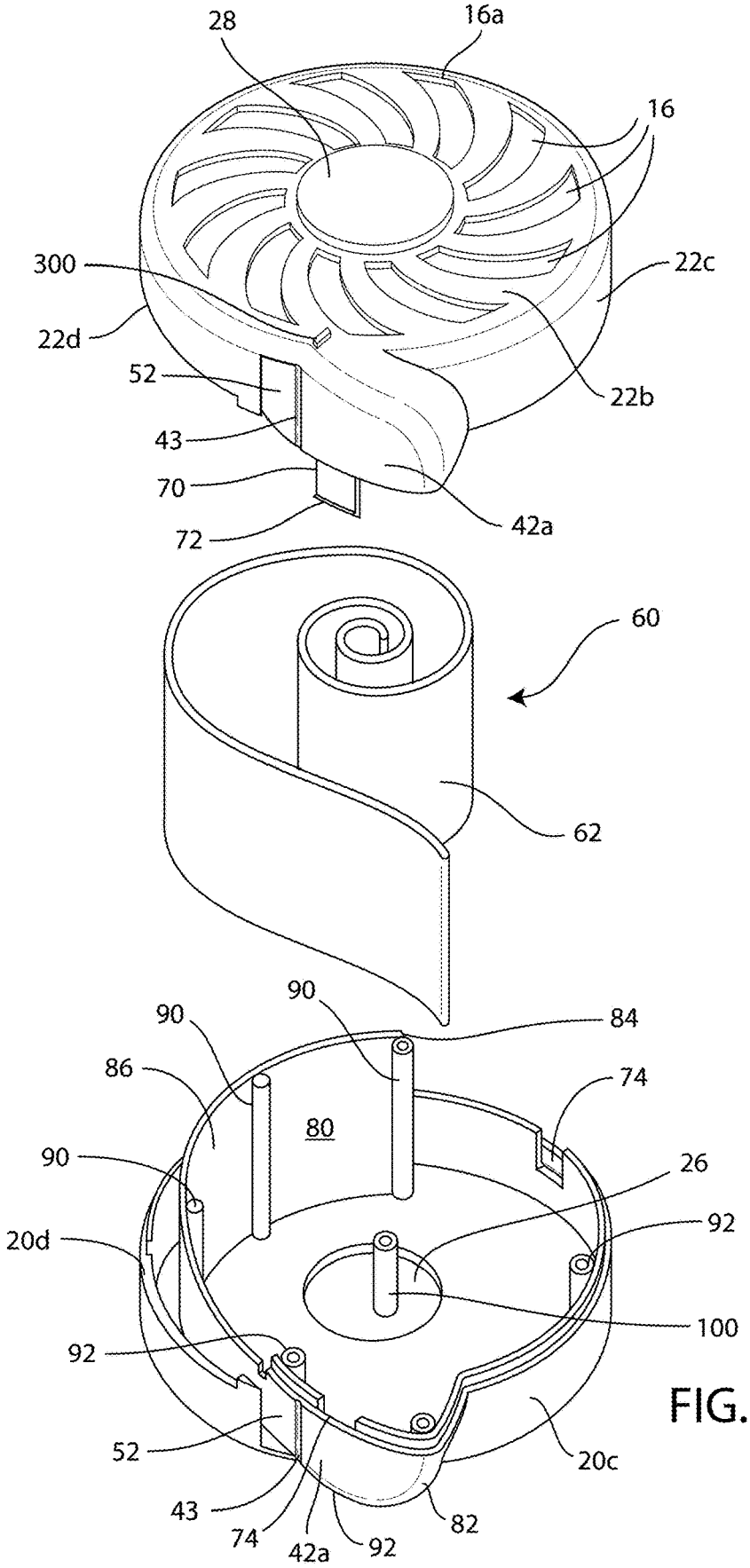
FIG. 9 illustrates in a second exploded view the two halves of the dispenser of FIG. 1 and the roll of tape of the edible product contained in the dispenser.
Figure 10:
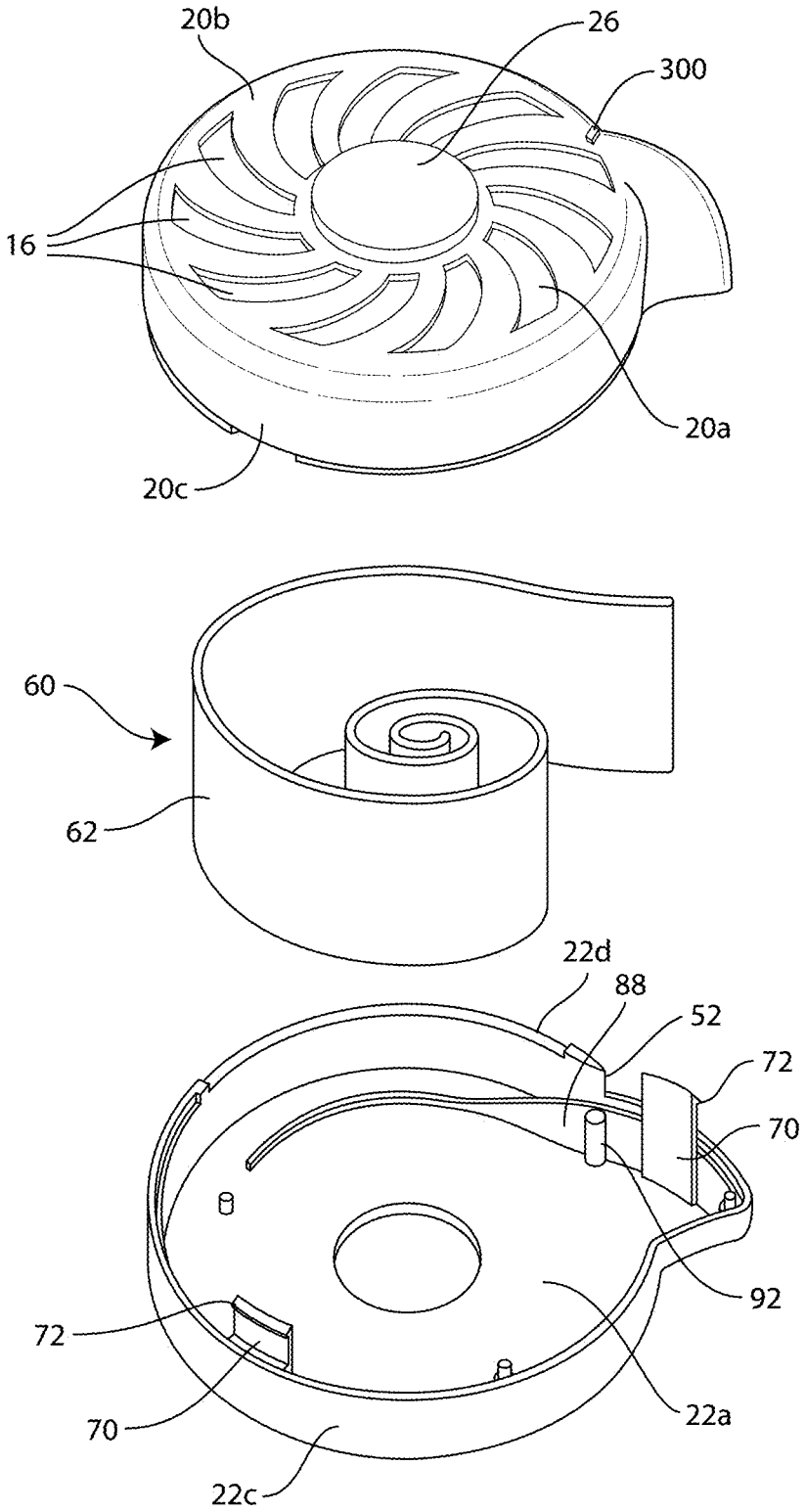
FIG. 10 illustrates in a third exploded view the two halves of the dispenser of FIG. 1 and the roll of tape of the edible product contained in the dispenser.

In FIGS. 8-10, the interior of the dispenser body 14 can be seen. FIG. 8 illustrates in a first exploded view the two halves of the dispenser body 14 and a roll 60 of an edible tape product 62 contained in the dispenser body. FIG. 9 illustrates in a second exploded view the two halves of the dispenser body 14 and the roll 60 of the edible tape product contained in the dispenser body. FIG. 10 illustrates in a third exploded view the two halves of the dispenser body 14 and the roll 60 of the edible product 62 contained in the dispenser body.

As can be seen in FIGS. 8-10 the left-side half 22 includes tabs 70 with hooks 72 whereas the right-side half 20 includes catches 74. As can be appreciated, when the two dispenser body halves 20 and 22 are joined, the hooks 72 of the tabs 70 are received in the catches 74 and thus the two halves are secured together.

The tabs 70 are formed along or secured to an interior of the circumferential partial wall portion 22*c*. The catches 74 are formed in an interior surface of the circumferential partial wall portion 20*c*. A first tab 70/hook 72/catch 74 arrangement is provide within the protrusion 40, while a second tab 70/hook 72/catch 74 arrangement is provided approximately 150 degrees, counterclockwise, as viewed from the left-side half 22, displaced from the first arrangement. These positions are not critical, but have been found to work sufficiently to hold together the two dispenser body halves 20 and 22.

The dispensing surface 42 can also be seen. As can be seen, the dispensing surface 42 is curvilinear and is the surface of a curvilinear wall member 80. The dispensing surface 42 has a first or distal end 82 at an outer end edge of the lip 42*a*. A second or proximal end 84 is located within the interior of the dispense body 14. Preferably, the wall member 80 is a continuation of the circumferential partial wall portions 20*c* and 22*c* and, thus, continuous with one or both. A first portion 86 of the wall member 80 is a continuation of the circumferential wall portion 20*c*. A second portion 88 of the wall member 80 is a continuation of the circumferential partial wall portion 22*c*. As can best be seen in FIGS. 8 and 9, the circumferential partial wall portion 20*c* is formed as a partial spiral so that portions thereof overlap as the wall member 80 portion 86 protrudes into the interior of the dispenser body 14. As best seen in FIG. 10, the circumferential partial wall portion 22*c* also is formed as a partial spiral so that a portion thereof overlaps as the wall member 80 portion 88 protrudes into the interior of the dispenser body 14. As a result of this structure a space or channel is provided between the wall member 80 and an interior surface of the third wall 25. The slot 50 overlies this channel and is in communication with it as described more fully below in connection with the operation of the dispenser 10.

While both portions 86 and 88 are comprised of portions of the dispensing surface 42, the portions 86 and 88, while complementary and mating, are not identical or even mirror images of each other. Instead, the left-side half 22 includes a much smaller portion 88 of the wall member 80, and hence, the surface 42. This smaller portion tapers downward (i.e., decreases in width in the axial direction) from the slot 52 to the interior or proximal end 84 of the wall member 80. In contrast, the right-side half 22 includes the larger portion 86 of the wall member 80, and hence the surface 42. This larger portion 86 tapers upward (i.e., increases in width in the axial direction) proceeding from the slot 52 to the interior or proximal end 84 of the wall member 80. The reason for this difference is that having the portion 86 providing most of the dispensing surface 42 provides an overall smoother surface, i.e., a surface free of seams and the like that could cause undue snagging or catching of the tape as it travels over the surface 42. This configuration, while preferable, is but one of various that would support formation of the dispensing surface 42.

As shown in FIGS. 8 and 9, the wall member 80 preferably includes optional stiffening members 90 in the form of rods formed with or abutting the wall member 80 on an underside 80*a* thereof. The illustrated embodiment has three such rods 90, but there could be more or less, or even none, depending on the flexibility of the wall member 80 and the need for stiffening rods to stiffen the wall member 80.

Additionally, other stiffening members or rods 92 may be present along the interior of the circumferential partial wall section 20*c* to provide stiffening of that section as well as the resulting third wall 25 of the assembled dispenser body 14.

In FIGS. 8 and 9, the spindle 100 can be seen protruding from the interior of one of the bosses 26 and 28, preferably boss 26, as illustrated. It can be appreciated that a roll of tape can be mounted on the spindle 100 and rotate thereabout as the tape is unraveled. Thus, the spindle 100 provides useful support for the roll of tape, and ensures that the roll does not abut against the interior end 84 of the dispensing surface 42 and the interior of the circumferential partial wall portions the third wall 25. It can be appreciated that edible products, and confectionary products in particular, can be sticky or tacky, and thus tend to stick to surfaces and could easily gum up the space between the dispensing surface 42 and the third wall 25.

Pusher

Figure 11:
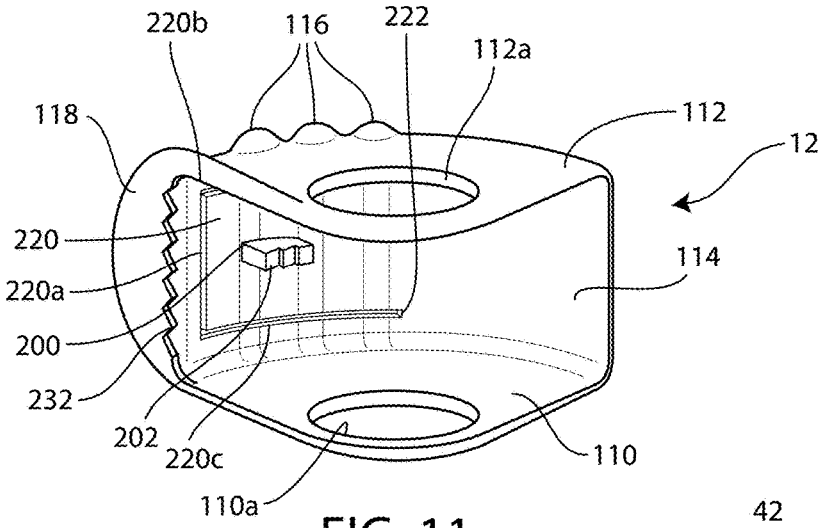
FIG. 11 illustrates an underside of the pusher of FIG. 1.
Figure 12:
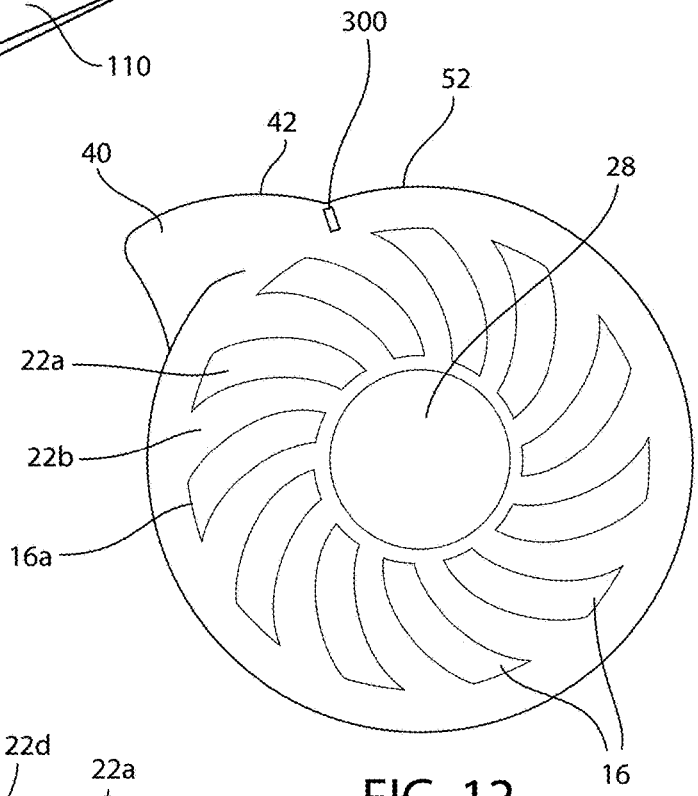
FIG. 12 illustrates a left-side view of the dispenser body of FIG. 1.
Figure 13:
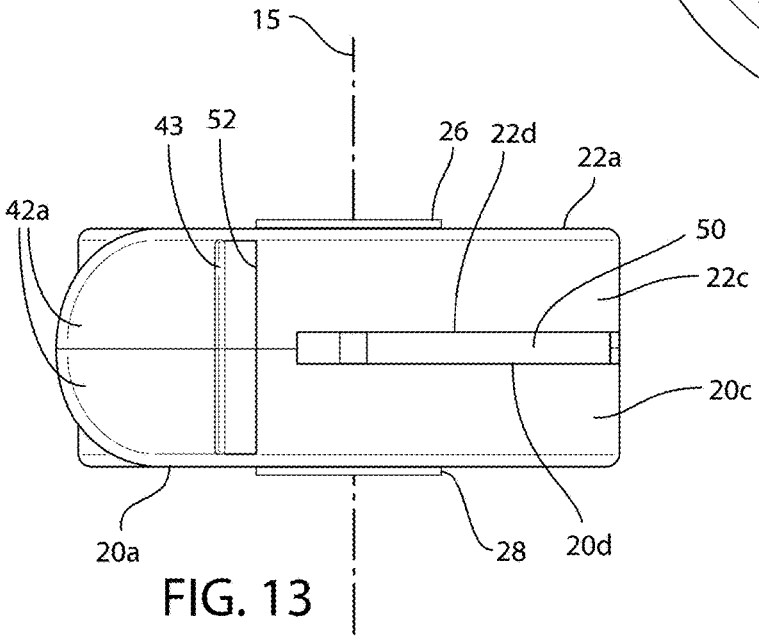
FIG. 13 Illustrates a top view of the dispenser body of FIG. 1.

The pusher 12 can be seen best in FIGS. 2, 7, and 11. In this preferred embodiment, the pusher 12 includes two spaced apart walls or panels or sides 110 and 112, and a third wall 114 from which the walls 110 and 112 depend. The panel 110 is a pusher right-side wall, while the panel 112 is a pusher left-side wall. The wall 114 is curved to be arcuate to conform about the curved or arcuate shape of the third wall 25.

Each of the panels 110 and 112 preferably is overall triangularly shaped with rectilinear sides extending from a common vertex while defining an angle of 65 degrees to 70 degrees between them. The exact angle is not important, but the recited angular range has been found to provide a sufficiently sized panel, while still allowing easy manipulation of the pusher 12 relative to the dispenser body 14.

The panels 110 and 112 include respective openings 110*a* and 112*a* in which are received the bosses 26 and 28. The openings are circular and have diameters that are sufficiently larger than the diameters of the bosses so that in addition to allowing pivotal movement of the pusher 12 relative to the dispenser body 14, the pusher 12 can be displaced perpendicularly relative to the axis 15, that is, the pusher 12 can be displaced toward and away from the dispenser body 14. In essence, the pusher 12 is loosely secured to the dispenser body 14 due to the differences in the diameters of the openings and the bosses.

As will become apparent, with this looseness, a user can more easily pivot the pusher about the dispenser body when the pusher is displaced away from the dispenser body.

The pusher 12 third wall 114 preferably includes ribs or ridges 116. These ribs 116 are three in number in the illustrated embodiment, but this number is not critical. The ribs 116 provide a textured outer surface to the wall 114 that enhances contact between a thumb of a user/consumer and the pusher 12 which, in turn, enhances manipulation of the pusher 12.

The pusher 12, also includes an end face member 118 at its distal end that, essentially, is an enlarge rib. This enlarged rib 118 is enlarged by being taller in a direction perpendicular to the axis 15 than the ribs 116, Further, an outer perimeter of the end face member is more rounded in a plane containing the axis 15 than are the perimeters of the ribs 116. The end face member 118 may also be thinner in the axial direction than the ribs 116.

In an embodiment, each rib 116 is about 3 mm or 1.5/16 in. tall in the radial direction, 4 mm or 3/16 in. wide at its base in the circumferential direction, and 3.2 cm or 1¼ in. long in the axial direction.

The extended perimeter of the end face member 118 serves as a ledge against which the thumb of the user can push to improve ease of manipulation of the pusher 12. Also it provides a member upon which the thumb can exert pressure during a cutting action described below.

In an embodiment, the end face member is about 1.3 cm or 1 in. tall in the radial direction, as measured from the top surface of the third wall 114. The width in the circumferential direction and the length in the axial direction are the same or about the same as those of the ribs 116.

As best seen in FIGS. 7, 11, and 14-18, on an underside of the wall 114 of the pusher 12, i.e., the surface of wall 114 facing the dispenser body 14, there is included a prong or nib 200 that fits within the circumferential slot 50, as mentioned above. Since the prong 200 extends into the slot 50, it also extends into the channel between the wall 25 and the wall member 80. Preferably, the prong 200 is sized to be able to reach the dispensing surface 42 when sufficient pressure is applied to the third wall 114 and/or the pusher 12 is moved toward the axis 15 by a user.

The prong or nib 200 includes a toothed or ridged surface 202 facing the dispensing surface 42. The teeth or ridges of the surface 202 preferably are similar to the teeth of slip joint pliers. Other surfaces with other textures or features can be used instead of the teeth. The purpose, however, is to better engage the tape to push it along the surface 42 as the pusher 12 is pivoted toward the protrusion 40.

In an embodiment, the prong 200 is about 7 mm and 9/16 in. long in the axial direction.

As shown best in FIGS. 1, 2, 7, and 11, the pusher 12, preferably, but not necessarily, is provided with a depressible tongue or flap 220 cut out of the third wall 114. The tongue 220 preferably is defined by three slits 220*a*, 220*b*, and 220*c* formed in the third wall 114 and flexes at a flexure point or axial line 222 (see, FIG. 11) along the wall 114. As illustrated, the slit 220*a* defines a distal end of the tongue 220, while the parallel slits 220*b* and 220*c* define sides of the tongue 220. The flexure line 222 defines the proximal end of the tongue 220.

The flexure line or region 222 can be a natural result of the use of a suitable flexible material for manufacture of the pusher 12, such as polypropylene, the length of the slits 220*b* and 220*c*, or the provision of a hinge such as via a living hinge or a thinning of the wall 114. Preferably, the flexure line or region is a combination of the type of material and the length of the slits 220*b* and 220*c*.

It can be appreciated, that with the provision of the tongue 220, it is possible to size the openings 110*a* and 112*a* of the pusher and the bosses 26 and 28 to be closer in diameter, and thus provide a tighter fit. The concern for allowing movement of the pusher 12 in a direction perpendicular to the axis 15 is lessened as the prong or nib 200 can be made to engage the tape 62 with depression of the tongue 220. However, even without the tongue 220, the pusher 12 can be sufficiently loosely fitted onto the bosses 26 and 2$ and/or have flexibility due to the material(s) of which the pusher is made to enable the prong or nib 200 to engage the tape 62 by simply pushing hard enough on the third wall 114.

Figure 4:
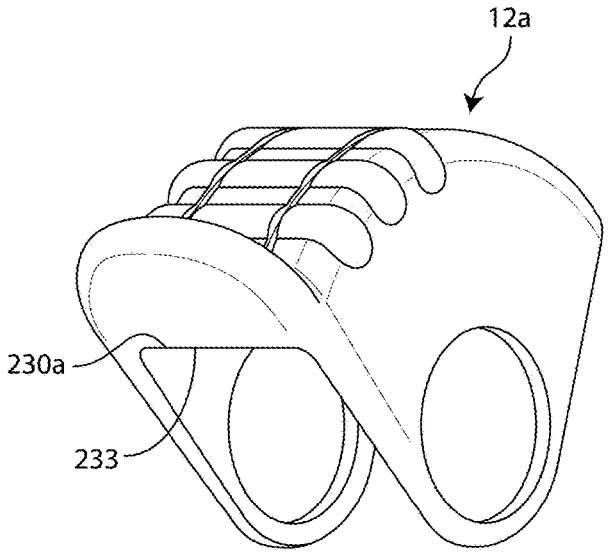
FIG. 4 illustrates in the first perspective view another pusher embodying other principles of the invention(s).
Figure 5:
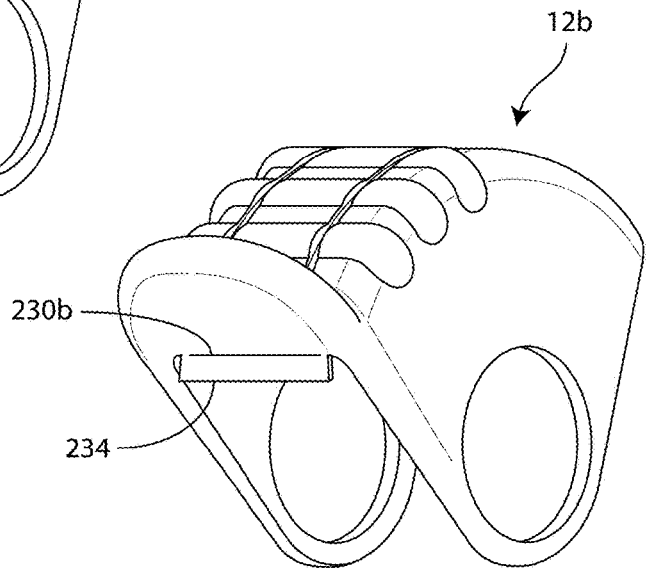
FIG. 5 illustrates in the first perspective view yet another pusher embodying other principles of the invention(s).

With reference to FIGS. 1, 2, 4, 5, 6, 7, and 11, at the distal end of the third wall 114, there also is provided a cutting edge 230 of the pusher 12. This cutting edge is provided to cut through the tape 62 on the dispensing surface thereby to separate or segment a portion thereof for consuming. As illustrated in FIGS. 1, 2, 6, 7 and 11, the cutting edge 230 can include teeth 232 formed as a portion of the end face member 118. However, it has been found that the cutting action of a pusher 12*a* can also be achieved using a cutting edge 230 having a straight edge 233 as shown in FIG. 4. Further, a cutting edge of a pusher 12*b* could be a straight-edged member or blade that protrudes or angles out from the end face 118, such straight-edge blade 234 shown in FIG. 5. The cutting edge could include a separately formed blade such as the serrated blades or edges commonly provided on or in kitchen plastic wrap or foil wrap packages.

As best seen in FIGS. 1-3, 9, and 13, the dispenser body 14 also includes the groove 43 that extends parallel to the axis 15. The groove 43 is positioned such that the cutting edge 230 can engage the groove when the pusher 12 is in its distal-most position. That is, when the pusher 12 is in its distal-most position, the cutting edge 230 can be forced into the groove. If the groove is sufficiently deep, the cutting edge 230 could cut all the way through the product. By this action the cutting edge 230 is better able to cut through the product and thereby cause the segmentation by the cutting action itself or with minimal tearing action by the user/consumer.

As best seen in FIGS. 2, 3, 7-10, and 12, the dispenser body 14 preferably includes two convexities or bumps 300, one on each side of the dispenser body. Preferably, these bumps are rectangular in shape in plan view and about 3 mm or ⅛ of an inch long with a slight height of about 1/32 of an inch. These bumps selectively engage the pusher 12 when the pusher 12 is in its distal-most position and act to lock the pusher in a closed position. In this distal-most position, the edges of the pusher panels 110 and 112 will extend distally beyond the bumps 300, and the bumps will engage and catch underside edges of the panels 110 and 112. However since the bumps are only slight in height, with sufficient effort that engagement action can be overcome and the pusher 12 can be moved toward a more proximal position to thereby engage and push out more product.

Operation

As described next, a push action occurs when a user/consumer moves the pusher 12 from a position spaced from its distal-most position toward its distal-most position. This could be from its proximal-most position or a position between its distal-most position and its proximal-most position. While the pusher 12 is being moved by causing it to pivot in a clock-wise direction as viewed from the left-side of the dispenser 10, the user/consumer simultaneously exerts sufficient pressure on the wall 114 to cause the prong 200 to extend further through the slot 50 and into the channel between the interior of the third wall 25 and wall member 80 and engage the tape 62, and thereby cause the tape to unravel as a portion thereof is urged out of the axial slot 52.

FIGS. 14-18 shown typical operation of the dispenser 10. FIG. 14 illustrates in cross section the right-side half 20 of the dispenser 10 and the coiled roil 60 of edible product 62 with the pusher 12 in a first position during a push action. FIG. 15 illustrates in cross section the right-side half 20 of the dispenser 10 and the roll 60 of edible product 62 with the pusher 12 in a second position during the push action. FIG. 16 illustrates in cross section the right-side half 20 of the dispenser 10 and the roll 60 of edible product 62 with the pusher 12 in a third position at the end of the push action, which in the illustrated case is the distal-most position of the pusher 12. FIG. 17 illustrates in cross section the right-side half 20 of the dispenser 10 and the roll 60 of edible product 62 with the pusher 12 in the third position, and a portion 62*a* of the edible product 62 separated from the roil 60. FIG. 18. illustrates in cross section the right-side half 20 of the dispenser 10 and the roll 60 of edible product 62 with the pusher 12 in a fourth position near the end of a retraction action, which is undertaken to initiate another push action.

The reference arrow 400 and 402 indicate the direction of travel of the pusher 12. Arrow 400 indicates a push action direction of motion. While arrow 402 indicates an opening direction of motion to reposition the pusher 12 for another push action.

As can be appreciated from these figures, the roll 60 of tape 62 of edible product preferably is mourned on the spindle 100 for rotation thereabout with unraveling/unwinding of the roll. An outer end of the tape 62 is fed to the channel between the dispensing surface 42 and the third wall 25.

As can be seen in FIGS. 14-18, a push action on the tape 62 in the dispenser 10 by the pusher 12 is used to extract a portion of the tape 62. The push action can start with the prong or nib 200 depressed to engage a portion of the tape already on the dispensing surface 42. As the pusher 12 is caused to rotate relative to the dispenser body 14, the depressed prong 200 engages the tape 62 and urges it out of the axial slot 52. When the desired amount of tape 62 is extracted, the pusher 12 has either reached its distal-most position, as shown in FIG. 16, or is otherwise manipulated by the user/consumer into the distal-most position by allowing the prong to release from the tape 62 while further pivoting the pusher 12.

With the pusher 12 in its distal-most position, the tape 62 can be cut or segmented by either sufficient cutting action by the cutting edge 230, or a combination of cutting action by the cutting edge 230 and tearing or ripping by the user/consumer.

Typically, the dispenser 10 is considered in a closed state with the pusher 12 in its distal-most position because in that state, the slot 52 is covered by the cutting edge 230, and the circumferential slot 50 is covered by the third wall 114. Any other position of the pusher 12 can be considered an open position, although the degree of openness will vary.

As can be appreciated from FIGS. 14-18, travel of the prong 200, unless overridden by sufficient lift of the prong by the user, is delimited by the distal edge of the slot 50 and the proximal edge of the slot 50. Thus, the user/consumer typically will extract a length of tape 62 substantially similar to this length of travel. However, less tape 62 can be extracted by starting the push action with the prong 200 at a position in between the two ends, as illustrated in FIG. 14. Further, it can be appreciated that a user/consumer might desire more tape 62 than is extracted using a full push action, and can simply pull on that portion of tape 62 that has already been extracted to cause the roll 60 unravel more and allow more tape 62 to exit the slot 52.

As can be appreciated, the tape 60 can be comprised of any suitable comestible product that can be formed into a tape or belt structure, preferably a rolled tape or belt structure. Examples of such products include candy leathers, fruit snacks, malleable confectionary products, and chewing gum.

Preferably the tape does not utilize a release paper or other support substrate but there is no reason such a paper or support substrate cannot be present. It would simply mean that the user would also have to control the cutting or tearing of the paper or support substrate as well as disposing of the same. Also preferably, the tape is coiled, i.e. rolled into a spiral. It may include a release powder or a coating between the layers to keep the layers of the coiled tape from sticking to each other.

The various part of the dispenser 10 can be made of different or the same materials, The materials preferably are plastics, especially thermoplastics which can easily be molded. However, as indicated above, with a suitably depressible tongue in the pusher, the plastic can be thermoset plastic. Preferably, the dispenser 10 parts are injection molded using a thermoplastic material The foregoing disclosure is not intended to limit the present disclosure to the precise forms or particular fields of use disclosed. As such, it is contemplated that various alternative embodiments and/or modifications to the present disclosure, whether explicitly described or implied herein, are possible in light of the disclosure. Having thus described embodiments of the present disclosure, a person of ordinary skill in the art will recognize that changes may be made in form and detail without departing from the scope of the present disclosure. Thus, the present disclosure is limited only by the claims.

As one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosed dispenser. It is to be understood that the forms of disclosure herein shown and described are to be taken as representative embodiments. Equivalent elements, or materials may be substituted for those representatively illustrated and described herein. Moreover, certain features of the disclosure may be utilized independently of the use of other features, all as would be apparent to one skilled in the art after having the benefit of this description of the disclosure. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural, Reference to "about" or "approximately" is to be construed to mean plus or minus 10%.

Further, the various embodiments disclosed herein are to be taken in the illustrative and explanatory sense, and should in no way be construed as limiting of the present disclosure. All joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary", "main" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It will also be appreciated that one or more of the elements depicted in the drawings/figures can also be implemented in a more separated or integrated manner, or even removed or rendered as inoperable in certain cases, as is useful in accordance with a particular application.

What is claimed is:

1. A dispenser comprising:

a dispenser body with an axis, the dispenser body having a first wall and a second wall that are spaced apart along the axis and a third wall connecting the first and second walls and extending around the axis; and a pusher external to the dispenser body, and pivotally secured to the dispenser body at outer surfaces of the first and second walls for movement around the axis, wherein, the dispenser body includes an interior space within which can be held an edible product, the dispenser body includes an opening in the third wall via which the edible product can be extracted, the dispenser body includes a dispensing surface upon which the edible product can travel, the dispenser body includes a slot in the third wall of the dispenser body over the dispensing surface, the slot extending longer in a direction other than parallel to the axis than in a direction parallel to the axis, and the pusher includes a prong that fits into and is extendible within the slot to engage with the edible product.

2. The dispenser of claim 1, wherein each of the first wall and the second wall includes a boss centered on the axis, and the pusher includes two spaced apart panels, each with an opening into which a respective one of the bosses is received.

3. The dispenser of claim 2, wherein each of the openings in the spaced apart panels of the pusher is sized larger than the boss engaged therein such that the pusher can be moved perpendicular to the axis thereby to permit the prong to engage and be disengaged from a surface of the edible product.

4. The dispenser of claim 2, wherein the pusher further comprises a partially separated tongue from which the prong extends, the tongue being depressible relative to a remainder of the pusher.

5. The dispenser of claim 1, wherein the pusher further comprises a partially separated tongue from which the prong extends, the tongue being depressible relative to a remainder of the pusher.

6. The dispenser of claim 1, wherein the dispenser body further comprises a protrusion extending from the third wall, an upper surface of which is comprised of the dispensing surface as a lip and a lower surface of which is spaced from the upper surface and which provides a finger-rest.

7. The dispenser of claim 1, wherein the first wall, the second wall, or each of the first wall and the second wall includes depressions in the outer surface thereof.

8. The dispenser of claim 7, wherein the depressions are effective to provide enhanced gripping of the dispenser relative to a smooth surface.

9. The dispenser of claim 1, wherein the first wall or the second wall includes a spindle which extends within the interior space and which can receive a roll of the edible product.

10. The dispenser of claim 1, wherein the dispensing surface is continuous with the third wall at the opening such that there is a continuous transition between the dispensing surface and the third wall.

11. The dispenser of claim 1, wherein the dispensing surface has a first section extending from an inner surface of the first wall and a second section that extends from an inner surface of the second wall.

12. The dispenser of claim 11, wherein:

the first section has first and second sub-sections relative to a circumferential direction around the axis, a width of the first sub-section along the axis being relatively smaller than a width of the second sub-section along the axis;

the second section has third and fourth sub-sections relative to the circumferential direction around the axis, a width of the third sub-section along the axis being relatively smaller than a width of the fourth sub-section along the axis, and the first sub-section faces the fourth sub-section and the second sub-section faces the third sub-section.

13. The dispenser of claim 1, wherein the pusher includes a cutting edge which can segment the edible product.

14. The dispenser of claim 13, wherein the cutting edge includes a serrated edge which can segment the edible product.

15. The dispenser of claim 13, wherein the cutting edge includes a blade which can segment the edible product.

16. The dispenser of claim 13 further comprising an axially extending groove in the third wall at a position to receive the cutting edge of the pusher.

17. The dispenser of claim 1, further comprising a locking mechanism to hold the pusher immobile relative to the dispenser body.

18. The dispenser of claim 17, wherein the locking mechanism includes two convexities on opposite sides of the dispenser body, which convexities are selectively engaged by the pusher.

19. The dispenser of claim 17, wherein the convexities are rectangular as viewed along the axis.

20. The dispenser of claim 1, wherein the third wall extends around the axis in an arcuate shape, and the pusher includes a conforming arcuately shaped wall overlying the third wall.

21. A dispenser and an edible product comprising:

a dispenser body with an axis, the dispenser body having a first wall and a second wall that are spaced apart along the axis and a third wall connecting the first and second walls and extending around the axis; and a pusher external to the dispenser body, and pivotally secured to the dispenser body at outer surfaces of the first and second walls for movement around the axis, wherein, the dispenser body includes an interior space within which is held the edible product, the dispenser body includes an opening in the third wall via which the edible product can be extracted, the dispenser body includes a dispensing surface upon which the edible product can travel, the dispenser body includes a slot in the third wall of the dispenser body over the dispensing surface, the slot extending longer in a direction other than parallel to the axis than in a direction parallel to the axis, and the pusher includes a prong that fits into and is extendible within the slot to engage with the edible product.

22. The dispenser and edible product of claim 21, wherein the edible product is in the form of a tape.

23. The dispenser and edible product of claim 22, wherein the tape is coiled into a roll.

24. The dispenser and edible product of claim 22, wherein the edible product is a confectionary product.

25. The dispenser and edible product of claim 24, wherein the confectionary product is a candy.

26. A dispenser body comprising:

an axis;

a first wall and a second wall spaced apart along the axis;

a third wall connecting the first and second walls and extending around the axis; and an interior space defined by the first wall, the second wall, and the third wall and within which interior space can be held an edible product;

an opening in the third wall via which the edible product can be extracted;

a dispensing surface upon which the edible product can travel, the dispensing surface having a proximal end within the interior space and a distal end outside of the interior space, the dispensing surface is continuous with the third wall such that there is a smoothly continuous transition between them; and a slot in the third wall over the dispensing surface, the slot extending longer in an arc about the axis than in a direction parallel to the axis.

27. The dispenser body of claim 26, further comprising a protrusion along the third wall, an upper surface of which is comprised of the dispensing surface as a lip and a lower surface of which is part of the third wall spaced from the upper surface and provides a finger-rest.

28. The dispenser of claim 26, wherein the depressions are effective to provide enhanced gripping of the dispenser relative to a smooth surface.

29. The dispenser body of claim 26, wherein the first wall, the second wall, or each of the first wall and the second wall includes depressions in the outer surface thereof.

30. The dispenser body of claim 26, wherein the first wall or the second wall includes a spindle which extends within the interior space and which can receive a roll of the edible product.

31. The dispenser body of claim 26, wherein the dispensing surface has a first section extending from an inner surface of the first wall and a second section that extends from an inner surface of the second wall.

32. The dispenser body of claim 31, wherein:

the first section has first and second sub-sections relative to a direction around the axis, a width of the first sub-section along the axis being relatively smaller than a width of the second sub-section along the axis;

the second section has third and fourth sub-sections relative to a direction around the axis, a width of the thirds sub-section along the axis being relatively smaller than a width of the fourth sub-section along the axis, and the first sub-section faces the fourth sub-section and the second sub-section faces the third sub-section.

33. A dispenser body comprising:

an axis;

a first wall and a second wall spaced apart along the axis;

a third wall connecting the first and second walls and extending in an arcuate shape around the axis; and an interior space defined by the first wall, the second wall, and the third wall and within which interior space can be held an edible product;

an opening in the third wall via which the edible product can be extracted;

a curvilinear dispensing surface upon which the edible product can travel, the dispensing surface having a proximal end within the interior space and a distal end outside of the interior space, the dispensing surface being arcuate in shape within the interior space; and a slot in the third wall over the dispensing surface, the slot extending longer in an arc about the axis than in a direction parallel to the axis.

* * * * *